United States Patent [19]

Steakley

[11] Patent Number: 4,886,176

[45] Date of Patent: Dec. 12, 1989

[54] PORTABLE LIQUID COOLER

[76] Inventor: Betty P. Steakley, 6289 Plumosa Ave., Fort Myers, Fla. 33908

[21] Appl. No.: 261,986

[22] Filed: Oct. 25, 1988

[51] Int. Cl.[4] ..... A45F 5/02; B65D 51/24; B65D 47/06

[52] U.S. Cl. ..... 215/229; 16/110.5; 62/371; 62/400; 215/1 A; 215/13.1; 220/90.4; 220/379

[58] Field of Search ..... 220/90.2, 90.4, 379; 215/1 A, 13.1, 229; 62/371, 400; 222/146.6, 211; 16/110.5

[56] References Cited

U.S. PATENT DOCUMENTS

| | | | |
|---|---|---|---|
| 71,443 | 11/1867 | Bennett | 220/379 |
| 438,898 | 10/1880 | Rodiger | 220/379 |
| 2,285,045 | 6/1942 | Moxley | 16/110.5 |
| 2,683,478 | 7/1954 | Seelig | 16/110.5 |
| 3,313,438 | 4/1967 | Piker | 215/13.1 |
| 3,558,033 | 1/1971 | Leeds | 215/1 A |
| 3,840,153 | 10/1974 | Devlin | 215/1 A |
| 4,244,477 | 1/1981 | Seel | 215/229 |
| 4,441,640 | 4/1984 | Lottick | 215/1 A |
| 4,448,316 | 5/1984 | Hiroshige | 215/1 A |
| 4,726,479 | 2/1988 | Tsai | 215/229 |

*Primary Examiner*—George E. Lowrance
*Attorney, Agent, or Firm*—Frank P. Cyr

[57] ABSTRACT

A portable liquid insulated cooler having a plug removably mounted on the top wall through which a flexible tubing extends providing a straw for drawing the liquid contents from the container. A receptacle containing a coolant is removably mounted on the top wall of the cooler and depends therefrom into the liquid in the cooler. The cooler is provided with a handle having a storage compartment for the flexible tubing.

7 Claims, 2 Drawing Sheets

FIG.1
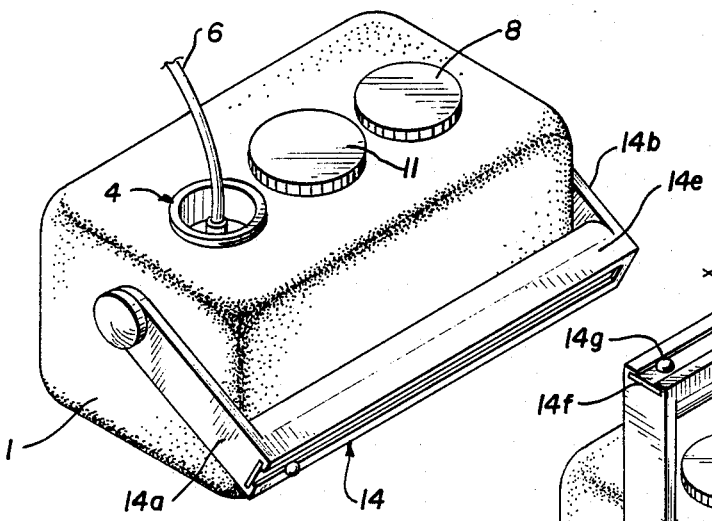
FIG.2
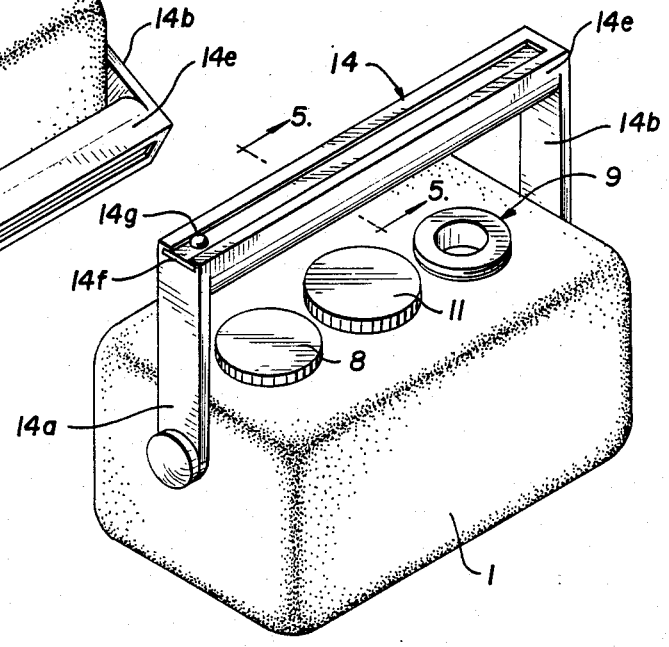
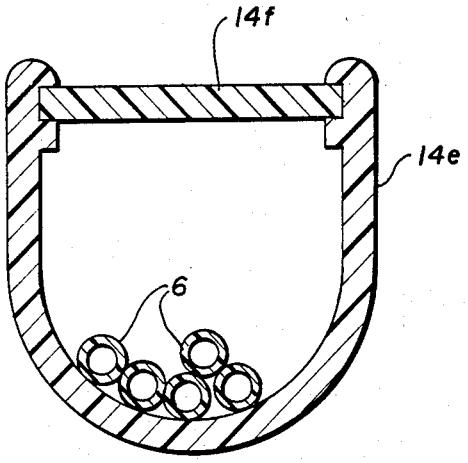
FIG.5
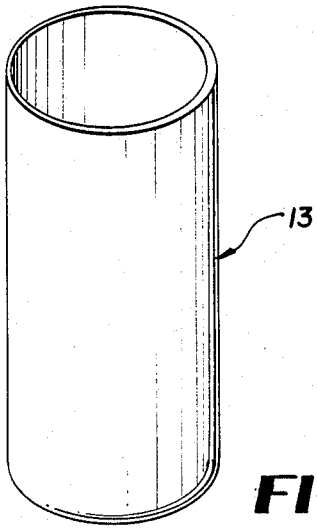
FIG.6

PORTABLE LIQUID COOLER

BACKGROUND OF THE INVENTION

In the mobile society in which we live, there are many situations in which it is inconvenient for an individual, while driving a vehicle such as an automobile, truck, boat, bicycle, or even merely walking, to stop for a drink of water or other cool refreshment when thirsty.

Various drinking apparatus have been proposed to permit the driver of a vehicle to drink water or other liquid while driving. One such arrangement is disclosed in U.S. Pat. No. 3,840,153, dated Oct. 8, 1974, wherein a container having flexible walls and a conduit extending into the container is removably clamped to the frame of a bicycle. While this drinking apparatus is adequate for its intended purpose, the removal and replacement of the container are, however, distracting and tends to interfere with the driver's view of the road.

To overcome this disadvantage, a drinking apparatus of the type disclosed in U.S. Pat. No. 4,095,812, dated June 20, 1978, has been proposed wherein an extensible drinking straw is provided which communicates with a water bottle clamped to a bicycle frame. While this apparatus is also adequate for its intended purpose, its construction and arrangement is such that the drinking apparatus becomes an integral part of the bicycle and therefore, is not portable to the extent that it can be readily used while driving other vehicles.

After considerable research and experimentation, the portable liquid cooler of the present invention has been devised to overcome the disadvantages experienced with prior portable liquid coolers and comprises essentially a container mounted within a housing in spaced relationship therewith and having insulation in the space between the outer wall surface of the container and the inner wall surface of the housing. A plug is threadably mounted in the top walls of the housing and container and is provided with a depending integral tube through which a flexible plastic tubing is adapted to extend into the container, and a removable closure is provided for closing the plug when the flexible tubing is not in place. A receptacle for containing a refrigerant is threadably mounted in the top walls of the housing and container, and a fitting is provided on the top wall of the housing for temporarily holding the removable closure when the flexible tubing has been inserted through the plug. The housing is provided with a hollow handle adapted to store the flexible tubing when not in use. The bottom wall of the liquid container is sloped in a direction toward the end of the tubing so that the liquid in the container will remain in the vicinity of the lower end of the tubing even when the contents of the container are low.

By the construction and arrangement of the portable liquid cooler of the present invention, the cooler may be carried and placed in a convenient location in a vehicle and the flexible plastic tubing can be inserted into the container and used as a straw for drawing the cool liquid therefrom.

BRIEF DESCRIPTION OF THE DRAWINGS

FIG. 1 is a perspective view of the portable liquid cooler of the present invention, showing the flexible plastic tube inserted therein;

FIG. 2 is a perspective view of the cooler illustrated in FIG. 1 with the flexible plastic tube removed therefrom;

FIG. 5 is a view taken along line 5—5 of FIG. 2; and

FIG. 6 is a perspective view of a mold employed for freezing a coolant for placing in the cooler refrigerant receptacle.

DESCRIPTION OF THE PREFERRED EMBODIMENT

Figure 3:
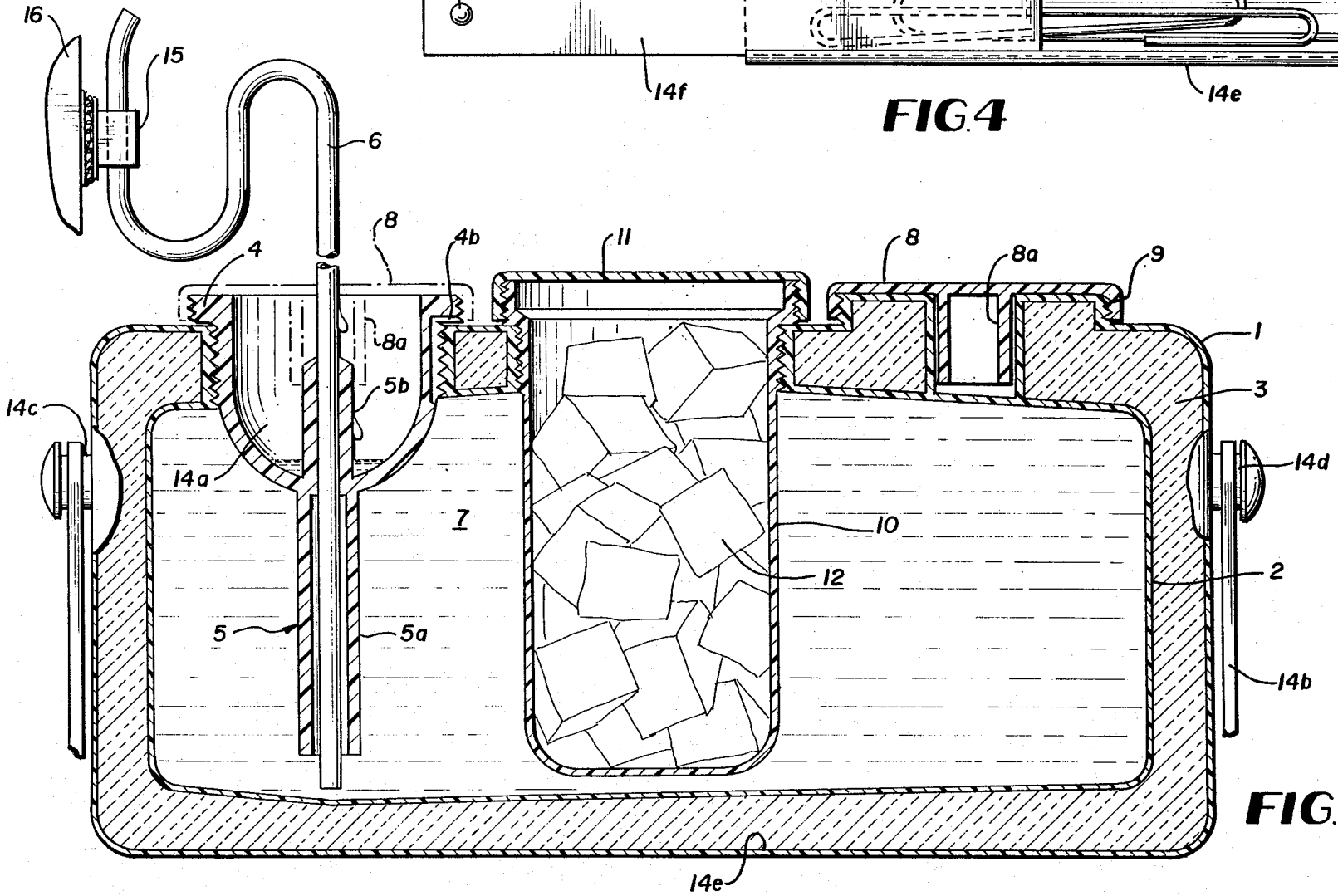
FIG. 3 is an enlarged, fragmentary sectional side elevational view of the cooler in the operative position.

Referring to the drawings, and more particularly to FIGS. 1, 2 and 3, the portable liquid cooler of the present invention comprises a housing 1 having a container 2 positioned therein in spaced relationship to the walls of the housing. Suitable insulation 3 is provided in the space between the outer wall surface of the container and the inner wall surface of the housing. A plug 4 is threadably mounted in the top walls of the housing and container and is provided with an integral tube 5 having a depending portion **5*a* extending downwardly into the container 2, and another portion 5*b* extending upwardly from the bottom wall of a recess 4*a* provided in the plug 4**.

A flexible plastic tubing 6 is adapted to be inserted through the integral tube 5 into the container 2, to thereby provide a straw for drawing the liquid 7 from the container. The relative diameters of the tube portion **5*b* and tubing 6 are such that there is a snug fit therebetween to prevent liquid from splashing out of the container 2. Any drops of liquid which might escape will drop into the recess portion 4*a*** of the plug.

In order that air can enter the container 2 as liquid is removed therefrom, a groove **4*b* is provided in the threaded portion of the plug to thereby provide a vent; and to close the plug 4 to prevent escape of the liquid from the container when the tubing 6 has been removed, a closure 8 is provided having a depending tubular portion 8*a* adapted to extend over the open end of the tube portion 5*b*, as shown in phantom in FIG. 3**.

A fitting 9 is also provided on the top wall of the housing 1 for temporarily holding the cap 8 when the flexible tubing 6 is being used.

A receptacle 10 having a closure 11 and containing a coolant or refrigerant 12 is also threadably connected to the top walls of the housing 1 and container 2 and depends therefrom into the liquid 7. While the coolant shown in FIG. 3 consists of ice cubes, it is contemplated that other frozen coolants or refrigerants might be employed.

In this connection, FIG. 6 illustrates a cylindrical mold 13 by which a coolant such as water can be frozen and removed therefrom in the form of a cylindrical solid for insertion into the receptacle 10.

Two or three of the molds 13 would be provided with each cooler so that a supply of ice is readily available.

Figure 4:
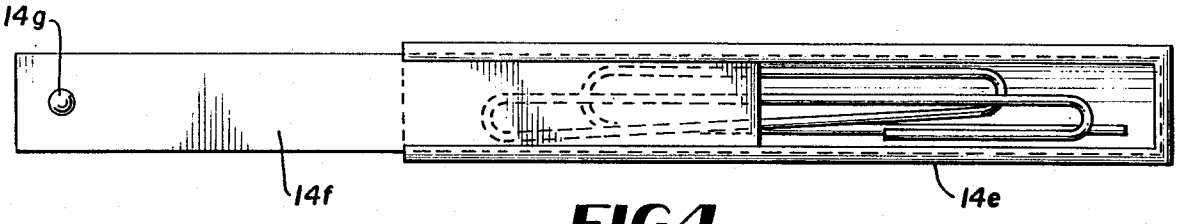
FIG. 4 is a top plan view of the handle showing the flexible plastic tubing stored therein.

To complete the structure of the portable liquid cooler of the present invention, a bifurcated handle 14 is provided having arm portions **14*a* and 14*b* pivotally connected to the end walls of the housing as at 14*c* and 14*d*. The bight portion 14*e* of the handle is hollow, as will be seen in FIG. 5, and is adapted to provide a storage compartment for the tubing 6 when not in use. A slidable closure 14*f* is provided for closing the storage compartment as shown in FIGS. 4 and 5, a button 14*g*** being provided on the closure 14*f* to facilitate the manual manipulation thereof.

In use, the cooler is filled with drinking fluid and a coolant, and carried by the handle 14. When it is desired to drink the liquid, the closure 8 is removed from the plug 4 and threaded onto the fitting 9. The tubing 6 is removed from the handle 14 and inserted through the tube 5 into the liquid 7. If the cooler is being used while driving a vehicle, the outer end portion of the tubing 6 can be removably held by a bracket 15 secured to the vehicle dashboard 16, to thereby make the drinking end of the tube 6 readily accessible to the driver.

The container 2 is dimensioned so that the opening in the top wall thereof through which the receptacle 10 extends is large enough to accommodate a person's hand to facilitate cleaning the interior of the container; the bottom wall of the container is sloped in a direction toward the lower end of the tube 5 and associated tubing 6 so that the liquid in the container will remain in the vicinity of the lower end of the tubing even when the contents of the container are low; and the upper or top wall is sloped in a direction toward the opening therein, through which the receptacle 10 extends, so that after washing, the cooler can be placed in upside-down manner to drain the wash water therefrom.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A portable liquid cooler comprising, a container having top, bottom and side walls, a drinking liquid in said container, a plug removably mounted on the top wall of said container, a recess provided in said plug, an integral tube connected to said plug, said tube having a depending portion extending from the bottom wall of said recess into said container and a portion extending upwardly from the bottom wall of said recess, a flexible plastic tubing insertable through said integral tube to thereby provide a removable straw for drawing the liquid from the container, the relative diameters of the upwardly extending tube portion and the tubing providing a snug fit therebetween to thereby prevent liquid from splashing out of the container, a closure removably mounted on said plug for closing the integral tube when the flexible tubing has been removed therefrom, said closure having a depending tubular portion adapted to extend over the upwardly extending portion of the integral tube, a receptacle containing a coolant removably mounted on the top wall of said container, said receptacle extending through an opening in said top wall and depending therefrom into the liquid within the container, the bottom wall of said container being sloped in a direction toward the tubing, whereby the liquid in the container will remain in the vicinity of the lower end of the tubing even when the contents of the container are low and the top wall of the container being sloped in a direction toward said opening so that after washing the cooler can be placed in an upside-down manner to thereby drain the wash water therefrom.

2. A portable liquid cooler according to claim 1 wherein a vent is provided in said plug whereby air may enter the container as liquid is drawn therefrom.

3. A portable liquid cooler according to claim 1, wherein a fitting is provided on the top wall of the container for temporarily holding the closure while the tubing is being employed, to thereby prevent loss of misplacement of the closure.

4. A portable liquid cooler according to claim 1, wherein the container is mounted within a housing in spaced relationship to the walls thereof, insulation being mounted in the space between the outer wall surface of the container and the inner wall surface of the housing, said plug and receptacle also being removably mounted on the top wall of said housing.

5. A portable liquid container, according to claim 4, wherein a carrying handle is connected to said housing.

6. A portable liquid container according to claim 5, wherein said handle is provided with a storage conpartment for storing the tubing when not in use.

7. A portable liquid container according to claim 6, wherein said handle is bifurcated and having arm portions pivotally connected to the end walls of the housing and the bight portion being hollow for receiving said tubing.

* * * * *